United States Patent [19]

Lempa, Jr.

[11] 4,296,584

[45] Oct. 27, 1981

[54] METHOD FOR OFFSET ANCHORING A FENCE POST

[76] Inventor: Bernard J. Lempa, Jr., 8422 Carvel La., Houston, Tex. 77036

[21] Appl. No.: 71,988

[22] Filed: Sep. 4, 1979

[51] Int. Cl.[3] ..... E02D 27/42

[52] U.S. Cl. ..... 52/742; 52/169.13; 52/170; 52/296

[58] Field of Search ..... 52/170, 295, 169.13, 52/514, 155–159, 742; 256/1, 19

[56] References Cited

U.S. PATENT DOCUMENTS

| | | | |
|---|---|---|---|
| 580,311 | 4/1897 | Hammett | 256/64 |
| 1,038,147 | 9/1912 | Johnson | 52/155 |
| 1,728,164 | 9/1929 | Zureck | 52/296 |
| 1,761,507 | 6/1930 | Williams | 52/296 |
| 3,724,145 | 4/1973 | Daniel | 52/157 |

FOREIGN PATENT DOCUMENTS

| | | | |
|---|---|---|---|
| 34493 | 5/1925 | Denmark | 52/296 |
| 218588 | 2/1910 | Fed. Rep. of Germany | 52/297 |
| 576236 | 8/1924 | France | 52/296 |
| 57423 | 8/1967 | German Democratic Rep. | 52/296 |

*Primary Examiner*—John E. Murtagh
*Attorney, Agent, or Firm*—Bill B. Berryhill

[57] ABSTRACT

A bracket for offset anchoring a fence post comprising a vertical leg member, a horizontal leg member, a post attachment means, and a means for anchoring the bracket to a new concrete foundation.

7 Claims, 5 Drawing Figures

METHOD FOR OFFSET ANCHORING A FENCE POST

BACKGROUND OF THE INVENTION

The present invention relates to a bracket which is used to offset anchor a fence post.

It would be desirable to use such a bracket when an existing wooden fence post has rotted through at its base, and the only alternative would be to remove the existing concrete foundation and post, and to replace it with a new foundation and new post of sufficient length.

The present invention allows a person to offset anchor the existing post without having to remove the existing foundation, and without having to provide for a new post of sufficient length.

OBJECTS OF THE INVENTION

The present invention has as one of its objects to provide a device which can be bolted or screwed to a fence post.

It is another object of the present invention to provide a device which can be anchored by means of a concrete foundation.

It is a further object of the present invention to provide a device which will offset the concrete anchor means in such a way that it will not interfere with the existing fence post foundation.

It is another object of the present invention to provide a device that can be easily and conveniently installed.

It is also an object of the present invention to provide a device which is inexpensive to manufacture.

SUMMARY OF THE INVENTION

The invention is a bracket which includes a vertical leg with bolt holes so that the leg can be bolted or screwed to the bottom end of a wooden fence post, and a horizontal leg which has attached to its underside an anchor means so that the bracket can be anchored to a new concrete foundation, said new concrete foundation being located immediately adjacent to the concrete foundation that originally anchored the post.

At installation, a hole of sufficient depth and diameter is dug in the soil adjacent to the existing foundation. The bracket is then attached to the bottom of the post by either bolts or lag screws, while the bracket anchor means extend down into the newly dug hole. Concrete is now poured into the hole until it fills to a level approximately flush with the bottom of the bracket horizontal leg.

After the concrete has set around the bracket anchor means, the affected post will again be supported firmly in place.

DESCRIPTION OF THE PREFERRED EMBODIMENT

Figure 1:
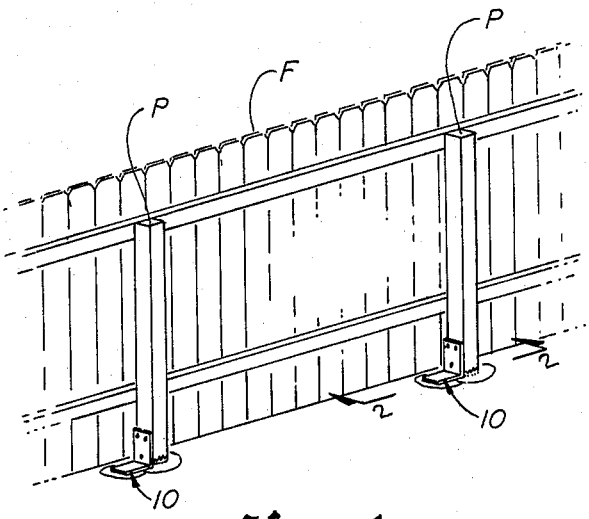
FIG. 1 is a perspective view of the present invention in operation.

With reference to FIG. 1, the bracket for offset anchoring a fence post P or any such related post which has rotted at its base, is shown generally as 10. It is shown supporting fence F.

Figure 2:
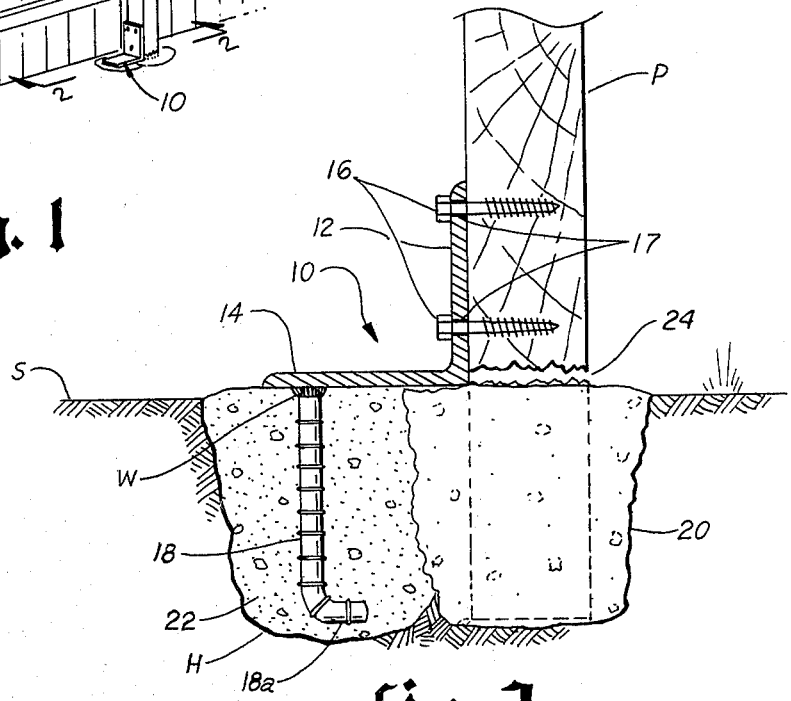
FIG. 2 is a sectional view of the present invention, taken along line 2—2 of FIG. 1.

Referring to FIG. 2, the bracket is shown in greater detail. The bracket 10 is composed of a vertical leg 12, said leg having sufficient number of holes 17 of adequate diameter to accommodate attachment bolts 16. In addition, the bracket 10 is composed of a horizontal leg 14, said leg having an anchor means 18 such as concrete reinforcing bar with a hooked end 18*a* attached to its underside by means of weld W. The horizontal leg 14 is of sufficient thickness to counteract the bending moment created by the fence during high wind or other such related loading conditions.

Referring again to FIG. 2, a hole H of sufficient depth and diameter is dug in the soil S immediately adjacent to the old concrete foundation 20. The rotted portion 24 of the post P can be seen above the old concrete foundation 20. The bracket 10 is now attached to the post P by means of attachment bolts 16 in a position such that the anchor means 18 of the bracket 10 extend down into the newly dug hole H. A concrete mixture 22 is now poured into the hole H until it fills to a level approximately flush with the bottom of the bracket horizontal leg 14.

Figure 3:
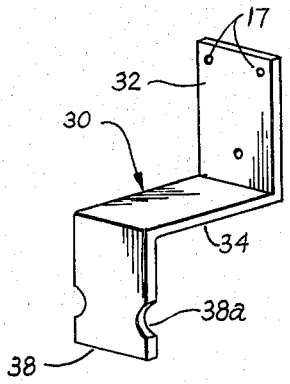
FIG. 3, FIG. 4, and FIG. 5 are perspective views depicting alternate configurations of the invention.
Figure 4:
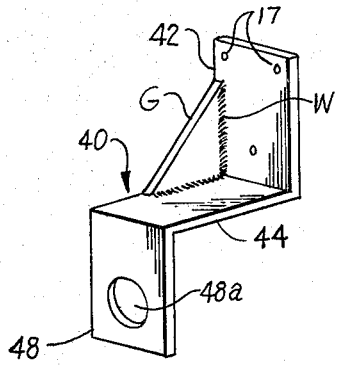
Figure 5:
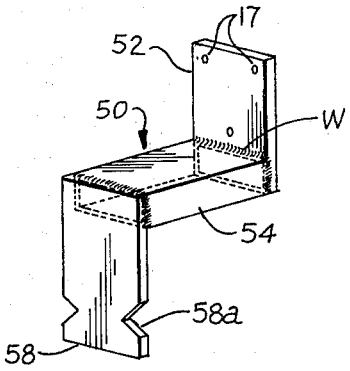

Referring to FIG. 3, FIG. 4, and FIG. 5 alternate embodiments of the bracket can be seen. In FIG. 3, the bracket 30 is composed of a vertical leg 32 with bolt holes 17, a horizontal leg 34, and an anchor leg 38 with grip notches 38*a*. In FIG. 4 the bracket 40 is composed of a vertical leg 42 with bolt holes 17, with a stiffener plate G attached by means of weld W, a horizontal leg 44, and an anchor leg 48 with grip hole 48*a*. In FIG. 5 the bracket 50 is composed of a vertical leg 52 with bolt holes 17, a torque box 54 attached by means of weld W, and an anchor leg 58 with grip notches 58*a*.

The invention claimed is:

1. A method of reanchoring a fence post which is no longer firmly supported in the ground without disturbing the existing post foundation or the fence structure associated therewith comprising the steps of:

digging a hole in said ground adjacent said post foundation;

attaching to the lower end of said post and next to said post foundation the vertical leg of a bracket which also has a horizontal leg from which depends an anchor member for disposition within said hole;

pouring a concrete mixture into said hole and around said anchor member to a level substantially flush with said horizontal bracket leg; and allowing said concrete mixture to set without disturbing said post and bracket.

2. A method of reanchoring a fence post as set forth in claim 1 in which said hole is dug on a side of said post foundation which faces the next post in said associated fence structure.

3. A method of reanchoring a fence post as set forth in claim 1 in which said anchor member comprises at least one rod member for vertical disposition within said hole and said concrete mixture.

4. A method of reanchoring a fence post as set forth in claim 1 in which said anchor member comprises a rectangular plate for vertical disposition within said hole and said concrete mixture, said rectangular plate having at least one hole therethrough through which said concrete mixture may flow and set for more firmly anchoring said bracket in said concrete mixture.

5. A method of reanchoring a fence post as set forth in claim 1 in which said anchor member comprises a rectangular plate for vertical disposition within said hole and concrete mixture, said rectangular plate having notches in the vertical edge thereof for more firmly anchoring said bracket in said concrete mixture.

6. A method of reanchoring a fence post as set forth in claim 1 in which said horizontal member is formed by a rectangular box one end of which is attached to said vertical member and the other end of which is attached to said anchor member.

7. A method of reanchoring a fence post as set forth in claim 1 in which a stiffener member is attached between said horizontal and vertical legs of said bracket.

* * * * *